US005946753A

United States Patent [19]

Roberts et al.

[11] Patent Number: 5,946,753

[45] Date of Patent: Sep. 7, 1999

[54] COMBINATION CIGAR CLIPPER AND BOTTLE OPENER

[76] Inventors: Ethan Roberts, 5510 Feagaville La., Frederick, Md. 21703; Noah Kady, 104 N. Main St., Apt. 1, Boonsboro, Md. 21713

[21] Appl. No.: 09/018,571

[22] Filed: Feb. 4, 1998

[51] Int. Cl.[6] ..... B25F 1/00; A24F 13/24

[52] U.S. Cl. ..... 7/156; 30/113; 81/3.55

[58] Field of Search ..... 81/3.55; 7/118, 7/151, 156, 158; 30/109, 111, 113, 123; D8/40; D27/195

[56] References Cited

U.S. PATENT DOCUMENTS

| | | | |
|---|---|---|---|
| D. 177,704 | 5/1956 | Amigone . | |
| D. 183,727 | 10/1958 | Emberton . | |
| D. 314,639 | 2/1991 | Rousseau . | |
| D. 375,576 | 11/1996 | Mesco . | |
| D. 380,863 | 7/1997 | Mikler . | |
| D. 386,814 | 11/1997 | Mesco | D27/195 |
| 1,106,733 | 8/1914 | Schleinkofer | 7/151 X |
| 1,166,881 | 1/1916 | Anderson | 30/113 |
| 1,199,784 | 10/1916 | Hall | 30/113 |
| 2,568,612 | 9/1951 | Cullen | 81/3.55 X |
| 2,856,804 | 10/1958 | Whiteley | 81/3.55 |
| 3,542,231 | 11/1970 | Wettermann . | |
| 4,560,344 | 12/1985 | Kietaibl . | |
| 4,569,653 | 2/1986 | Becker et al. . | |
| 4,967,622 | 11/1990 | Phillips | 7/151 X |
| 5,664,331 | 9/1997 | Yu | 30/113 |
| 5,715,602 | 2/1998 | Hage | 30/111 X |

*Primary Examiner*—D. S. Meislin
*Attorney, Agent, or Firm*—Richard C. Litman

[57] ABSTRACT

A combination cigar clipper and bottle opener having a substantially rectangular configuration with a fixed bottle opener at one end and a D-shaped handle at the other end. The D-shaped handle is attached to a blade which is slidably disposed within the hollow rectangular housing and is adapted for clipping off the end of a cigar. An aperture, through which cigars may be inserted for clipping off the ends, is positioned centrally to the rectangular housing.

8 Claims, 2 Drawing Sheets

COMBINATION CIGAR CLIPPER AND BOTTLE OPENER

BACKGROUND OF THE INVENTION

1. Field of the Invention

The present invention relates generally to a combination tool. More specifically, the invention relates to a portable combination cigar clipper and bottle opener.

2. Description of the Related Art

For centuries cigar smokers and drinkers have found themselves at the mercy of the bartender or other persons in saloons and bars of the past including the more modern local bars for the need of a bottle opener or utility knife for respectively removing a cap from a bottle or salvaging a cigar without ashes from an astray for later use or carry. These basic needs, which typically arise within the social dynamic of most saloons and bars for example, can often interrupt and thus ruin "the moment" of an otherwise good discussion between two or more people, and, conceivably, foster dependence upon someone else for help and thus be construed as a sign of social weakness. As a result of this and similar or related practical problems, there has been a need for a combination tool which conveniently and easily allows for the clipping of a cigar or the opening of a bottle.

Many combination tools have been devised for various utilities, except the portable combination cigar clipper and bottle opener as herein described. Conventional combination tools like that described in the U.S. Design Pat. No. 177,704 issued to Amigone discloses a smoker's accessory design which resembles a letter-opening tool or sharp tipped tool. The patent also shows other uses such for its design, as a bottle opener. This tool is very different from that of the instant invention in that it is quite long and has sharp tips which are potentially dangerous and could be injurious to a user when carried as a tool in a pocket. Furthermore, the device would be an uncomfortable fit in a typical pant pocket as it may protrude from the pocket. Another mechanism is illustrated by the Design Patent of Amigone, but it is quite unclear as to its function or proper use.

U.S. Design Pat. No. 314,639 issued to Rousseau diagrammatically illustrates a cigar cutter which resembles a portion of that of the instant invention, but fails to teach a combination tool wherein the tool has the dual purpose of clipping cigars and opening bottles.

U.S. Design Pat. No. 183,727 issued to Emberton diagrammatically illustrates a combined belt buckle, bottle opener and can opener. While this device is a dual purpose tool and has the feature of portability as belt buckle, there is no suggestion for a combination cigar clipper and bottle opener of the instant invention.

Other U.S. Design Patents such as those by Mesco (375,576) and Mikler (380,863) teach conventional features of a single purpose cigar clipping tool. Both of these devices lack the structural features and dual purpose utility of the instant invention.

U.S. Patents by Wettermann (U.S. Pat. No. 3,542,231), Kietaibl (U.S. Pat. No. 4,560,344) and Becker et al. (U.S. Pat. No. 4,569,653) further disclose combination tools having the dual purpose as a bottle opener and cigarette lighter respectively. However, there is no teaching for the combination tool of the instant invention.

The herein described combination cigar clipper and bottle opener is different in that it provides a dual utility as a cigar clipper and bottle opener in a single light-weight unit, which can be comfortably carried in a pant or other pocket for easy access. This feature of the combination tool is neither taught nor suggested by the related art. Thus, none of the above inventions and patents, taken either singularly or in combination, is seen to describe the instant invention as claimed. Thus, a combination cigar clipper and bottle opener solving the aforementioned problems is desired.

SUMMARY OF THE INVENTION

The present invention is a combination tool which has a substantially rectangular configuration with a fixed bottle opener at one end and a D-shaped handle and blade at the other end. The D-shaped handle is permanently attached to the blade which is slidably disposed within a hollow rectangular housing and is adapted for clipping off the end of a cigar. An O-shaped or circular aperture, through which cigars may be inserted for clipping off the ends is centrally positioned within the rectangular housing.

Accordingly, it is a principal object of the invention to provide a portable combination cigar clipper and bottle opener.

It is another object of the invention to provide a portable combination cigar clipper and bottle opener which is not potentially injurious to a user.

It is a further object of the invention to provide a combination cigar clipper and bottle opener which can be carried in a pant pocket or other pocket as a light weight combination tool.

Still another object of the invention is to provide a combination cigar clipper and bottle opener which can include various personalized ornamental designs.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to a combination cigar clipper and bottle opener. A preferred embodiment of the present invention is depicted in FIGS. 1 and 2, and is generally referenced by numeral 3.

Figure 1:
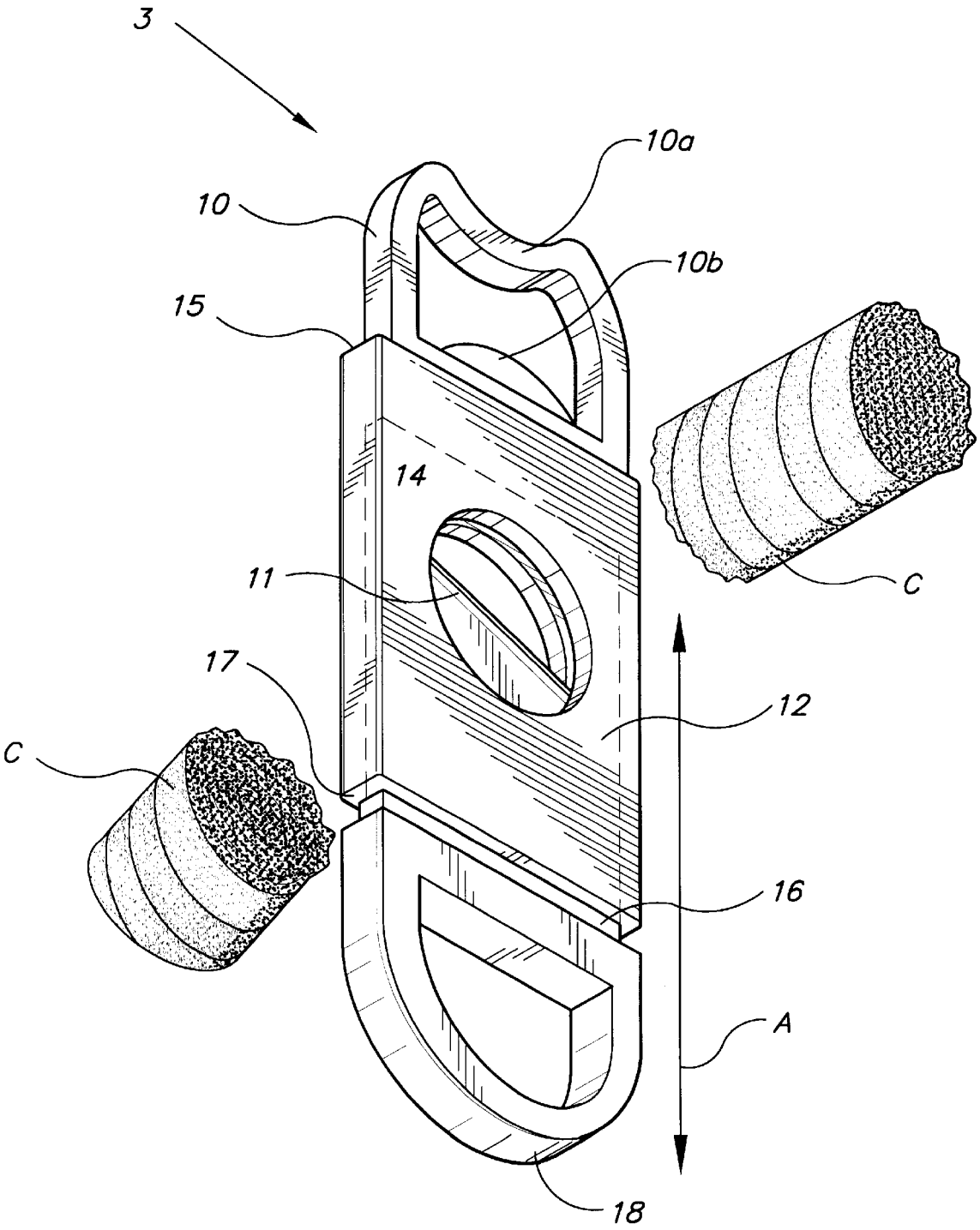
FIG. 1 is an environmental, perspective view of the combination cigar clipper and bottle opener according to the invention, illustrating the slidable D-shaped handle and blade assembly and its utility as a cigar cutter.
Figure 2:
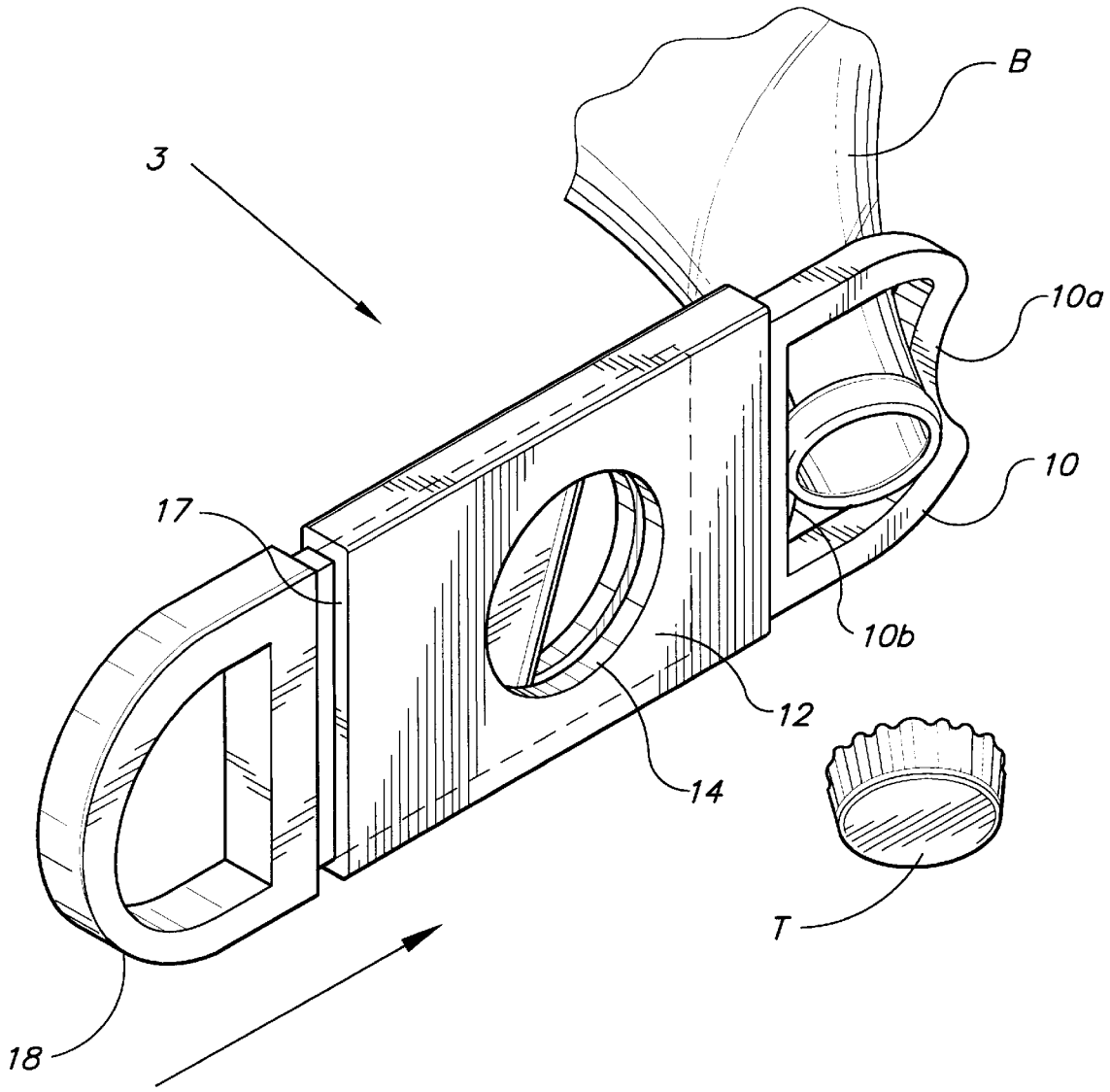
FIG. 2 is an environmental, perspective view of the combination cigar clipper and bottle opener according to the invention, illustrating its utility as a bottle opener.

As seen in FIG. 1, the combination cigar clipper and bottle opener 3 comprises a bottle opener 10, a substantially hollow cigar cutter housing 12 having a central circular aperture 14, a blade 16 inserted within the housing 12 and a handle 18 for slidably moving the blade 16 up and down the length of the housing 12 therein. The housing 12 comprises first 15 and second 17 ends. The blade 16 has a sharp edge 11 and an opposed blunt end (not shown). The handle 18 is a D-shaped handle and is fixedly attached to the blunt end of the blade 16.

The D-shaped handle is unique in that it conforms nicely to the curvature of a hand when removing items from a pocket. Also, this configuration does not lend itself to self-inflicted wounds caused by potentially sharpened surfaces. The handle 18 can be attached by any number of attachment methods readily available to the skilled artisan, such as metallic bonding or via attachment screws. The preferred method of attachment diagrammatically represented in FIG. 1 is metallic bonding.

The blade 16 of the instant invention is also slidably and releasably attached to the handle 18 by any suitable means, in order to permit inspection and sharpening of the blade after removal of the composite blade 16 and handle 18 as a single unit. To reduce the occurrence of rust and bending of the blade 16, it is preferably made of stainless steel or similar stainless metallic material having reasonable structural rigidity for the intended purpose. The D-shaped handle 18 is similarly constructed of a stainless metallic material, but may be a composite hard plastic material in the alternative.

As indicated in FIG. 1 by phantom lines, the recessed area of the housing 12 wherein the blade 16 rests is suggested. The double headed arrow A shown in FIG. 1 illustrates the movement of the blade 16 within the housing 12 in this recessed area, for clipping a cigar C inserted through the aperture 14. The material chosen for the housing 12 is also particularly important because the housing preferably includes designs or personal inscriptions applied directly on or into the surfaces. Moreover, the structural integrity of the housing should also limit flexing which may otherwise interfere with the reciprocal movement of the blade. A choice of plastic or metal, as appropriate to the type of surface ornamentation desired, e.g. molded or etched, is preferred.

As best shown in FIG. 2, the first end 15 of the housing is fixedly attached to a substantially rectangular-shaped looped bottle opener 10 and diagrammatically illustrates a bottle B having a top T inserted within the loop of the opener 10 for removing the top from the bottle B. The bottle opener 10 further includes a concave-up recess 10*a* disposed substantially along a top surface of the loop for placement of a user's thumb during operation of cigar clipper. A semi-circular lip portion 10*b* of the loop serves as a stabilizing means for removing bottle caps as shown in the figure. During use of the opener 10, the blade 16 is in a closed state, wherein the second end 17 and the bottom surface of the handle 18 abut and the sharpened edge 11 is hidden inside the housing 12. This state occurs readily as a result of the blade 16 being forced inward by the handle 18 abutting the hand during use of the tool 3 as a bottle opener, causing the aperture 14 to be fully closed.

The bottle opener 10 is preferably a stainless metallic material such as stainless steel, and is fixedly attached to the first end 15 by attachment methods well known to the skilled artisan which provide the needed structural rigidity and durability for the intended purpose. In this regard, the structure of the opener 10 is rigid and durable to reduce wear and failure due to fatigue from constant use. Stainless metal materials will also serve to minimize rusting, which typically destroys the luster of a metallic finish making the tool 3 otherwise less desirable.

It is to be understood that the present invention is not limited to the embodiments described above, but encompasses any and all embodiments within the scope of the following claims.

We claim:

1. A combination cigar clipper and bottle opener comprising:

a substantially hollow cigar cutter housing having a first end with a mouth and closed second end, and having a through-aperture located therebetween;

a blade slidably and reciprocally inserted into the mouth of said housing and dimensioned in length to closely pass by the aperture when fully inserted;

a D-shaped handle attached to the blade, said blade having a sharp edge at one end and an opposing blunt end, the handle fixedly attached to the blunt end of said blade; and a bottle opener attached to the second end of the housing said bottle opener being a substantially rectangular loop having a concave recess along a top portion of said loop for placement of a thumb, said bottle opener further includes a substantially semi-circular lip disposed within said loop on an interior surface opposite said recess.

2. The combination cigar clipper and bottle opener according to claim 1, wherein the bottle opener is made of a stainless metallic material.

3. The combination cigar clipper and bottle opener according to claim 1, wherein the housing is substantially rectangular.

4. The combination cigar clipper and bottle opener according to claim 2, wherein the housing is made of a stainless metallic material.

5. The combination cigar clipper and bottle opener according to claim 2, wherein the housing is made of a composite hard plastic material.

6. The combination cigar clipper and bottle opener according to claim 1, wherein the blade is substantially rectangular.

7. The combination cigar clipper and bottle opener according to claim 6, wherein the blade is made of a stainless metallic material.

8. The combination cigar clipper and bottle opener according to claim 1, wherein the handle is made of a stainless metallic material.

* * * * *